United States Patent [19]

DiNapoli et al.

[11] Patent Number: 5,029,922

[45] Date of Patent: Jul. 9, 1991

[54] WAFER PROCESSING CASSETTE HANDLE

[75] Inventors: Antonio DiNapoli; Gerald L. Goff, both of Austin, Tex.

[73] Assignee: Advanced Micro Devices, Inc., Sunnyvale, Calif.

[21] Appl. No.: 482,180

[22] Filed: Feb. 20, 1990

[51] Int. Cl.[5] ..... B65D 25/28

[52] U.S. Cl. ..... 294/27.1; 294/34

[58] Field of Search ..... 294/27.1, 33, 34, 16, 294/103.1; 16/114 R

[56] References Cited

U.S. PATENT DOCUMENTS

| | | | |
|---|---|---|---|
| 2,243,305 | 5/1941 | Adler | 294/34 |
| 2,786,707 | 3/1957 | Campbell | 294/34 |
| 3,076,223 | 2/1963 | Reichold | 294/34 X |
| 3,939,973 | 2/1976 | Wallestad | 294/27.1 X |
| 4,195,871 | 4/1980 | Chilton et al. | 294/16 |

OTHER PUBLICATIONS

Western Electric Technical Digest, No. 28, 10-1972. .

*Primary Examiner*—Margaret A. Focarino
*Assistant Examiner*—Dean J. Kramer
*Attorney, Agent, or Firm*—Johnson & Gibbs

[57] ABSTRACT

A removable handle for use in handling semi-conductor wafer processing cassettes includes a horizontally extending front coupling bar with coupling channels on each end for engaging flanges on the cassette. A handle includes a body portion which is mountable to and extends transversely from the coupling bar. A grip portion extends angularly from the body and is furnished with contoured finger portions. The grip includes a finger trigger for actuating a spring biased resilient plunger mechanism to engage the sidewall of the cassette and secure it to the coupling bar. The grip also includes a thumb latch for releasing the plunger mechanism, in resonse to the spring bias, and allowing the handle to be disengaged from the cassette.

16 Claims, 3 Drawing Sheets

WAFER PROCESSING CASSETTE HANDLE

BACKGROUND OF THE INVENTION

1. Field of the Invention

The present invention relates to semi-conductor wafer handling equipment, and more particularly, to a removable handle for semi-conductor wafer processing cassettes.

2. History of the Prior Art

In the manufacture of semi-conductor devices, such as integrated circuits, a plurality of devices are formed on a single circular wafer of silicon material. The wafer is typically circular and on the order of 6 inches in diameter. The wafers are put through a number of sequential processing steps, including coating them with photo-resists, exposing them to the optical patterns formed on photo masks, and passing them through both liquid and gaseous treating environments.

The processing of a silicon wafer containing a plurality of semi-conductor devices requires a high degree of cleanliness and sterility in the environment in order to produce acceptable devices. The ability of a semi-conductor device to perform satisfactorily from both an electrical and mechanical standpoint depends on the nature and quality of the materials forming the various layers of the device. The chemical composition of these materials must be extremely pure. The introduction of any foreign matter into the environment where the wafers are being processed results in a decrease in the "yield" of the wafer. The yield is the number of devices that can pass the required electrical tests of the device after the processing has been completed. This is usually expressed as a fraction of the total number of devices processed on the wafer. Thus, the higher the purity of the processing environment and processing techniques used in manufacturing the semi-conductor devices, the greater the yield and hence the greater the financial return to the manufacturer.

Silicon wafers are generally handled in inert plastic frames containing a plurality of vertically arranged dividers. Each divider defines a pocket to receive a silicon wafer and holds it securely in a vertical orientation while isolating it from adjacent wafers. The plastic frame and divider assembly is generally referred to as a "cassette." A typical industrial cassette will hold on the order of 60 wafers for processing. The cassettes must be physically moved by operators from processing station to processing station where the cassettes are placed into indexing mechanisms forming part of the processing machinery of each station. The wafers are automatically removed and again placed into cassettes by the indexing mechanisms after the processing step at each station has been completed. To guard against the introduction of impurities into the silicon wafer processing environment, the operators all wear caps, gowns and surgically sterile rubber gloves when they are handling the cassettes. In addition, the operators frequently change gloves, sometimes three to four times per day, to reduce the amount of contaminants effecting the wafer processing environment. The manner in which even gloved operators handle the cassettes has been shown to have a substantial impact upon the number of unwanted particles found contaminating the surface of the wafer. This, of course, results in impurities and defective devices on the wafer. It has also been noted that each individual operator seems to have a fairly consistent yield rate which is apparently somehow connected with the manner in which that operator handles the wafer cassettes.

It has been shown by tests that the contact of the wafer cassette by a surgically gloved human hand also produces a certain level of impurities in the wafers closest to the contact. In order to avoid such contact, various cassette handling tools have been proposed within the industry including elongate single handles, latching tongs, and other mechanisms for increasing the minimum distance between the operator and the cassette. However, there are a number of inherent disadvantages in the prior art wafer cassette handling tools. Many of the prior art tools require two handed operation and thereby decrease operator dexterity. Such tools prevent the operator from having one hand free to provide stability and backup in the event it is needed. Additionally, the two handed operation doubles the risk of contamination due to the close location of two hands to the wafers. A single cassette full of finished silicon wafers may be worth on the order of $25,000.00 and as such must be handled cleanly, carefully and securely. Other proposed cassette handles have included loose fitting devices which temporarily engage the cassette for handling. These devices are subject to slippage, droppage and disconnection due to the non-rigid attachment of the handle to the cassette.

It would thus be desirable to provide an easy to use removable handle for a wafer cassette which can be selectively and rigidly attached to the cassette for as long as necessary in the processing operation. The handle should be quickly detachable from the cassette for reuse with another unit. The detachable handle of the present invention provides such a device.

SUMMARY OF THE INVENTION

The present invention pertains to a removable handle for a semi-conductor wafer processing cassette. The handle is constructed with means for securely attaching the handle to the cassette so that the hand of the operator remains a select distance away from the cassette at all times during the handling operation. The handle can also be rigidly attached to the cassette and remain there during the time that the cassette is still undergoing processing by a manufacturing station and then be quickly detached for reuse with another cassette.

One object of the present invention is to provide an operator handle for demountable securement to a silicon wafer processing cassette that has at least one space adapted for receiving a silicon wafer therein so as to facilitate operator handling of the wafer cassette. The handle may include a transverse member having first and second ends, with the first end of the transverse member being constructed to permit an operator's grasp thereof, and the second end of the transverse member having a means for engaging the cassette and the support thereof. The second end further including a means in association with the engagement means for temporarily securing the cassette to the handle.

A further object of the present invention is to provide a securing means comprising a coupling arm and biasing means that is constructed within the coupling arm for engaging the cassette and applying a securement force thereto. The biasing means may be actuatable by a trigger disposed in the vicinity of the handle but disposed away from the engagement means. The coupling arm may also comprise an elongate strip orthogonally disposed across the second end of the transverse member. The coupling arm may further include two channels spaced apart one from the other and adapted for engaging sections of the cassette.

A still further object of the present invention is to provide a biasing means comprising a shaft reciprocally mounted within the transverse member and that may be adapted for extending outwardly of the coupling arm to engage the cassette. The shaft may further include a trigger disposed in the vicinity of the handle that permits actuation of the biasing means by an operator at a remote position from the cassette. The actuation of the biasing means would impart an outward movement of the shaft into engagement with the cassette. The shaft may further include a locking means for temporarily securing the outward extension of the shaft and for temporary securement of the cassette to the engagement means.

A still further object of the present invention is to provide an improved method of handling a cassette of the type adapted for housing silicon wafers during wafer manufacture and processing. The method may comprise the steps of providing a handle assembly capable of demountably coupling to the cassette. The handle assembly includes a transverse arm with a handle disposed upon a first end an elongate coupling member disposed upon a second end, the coupling including first and second flanges adapted for matingly engaging the cassette. The improvement in the method of handling silicon wafer cassettes includes a means in association with the handle assembly for biased engagement with the cassette and for remotely actuating the biasing means in order to secure the cassette to the handle assembly. The improved coupling step further includes providing an abutment member for engagement of the cassette. The abutment member may be disposed along the elongate coupling member. A securement force may be applied against the cassette by mating the elongate coupling member with the cassette and actuating the abutting member against the cassette.

BRIEF DESCRIPTION OF THE DRAWINGS

For an understanding of the present invention for further objects and advantages thereof, reference may now be had to the following description taken in conjunction with accompanying drawings, in which.

DESCRIPTION OF THE PREFERRED EMBODIMENT

Figure 1:
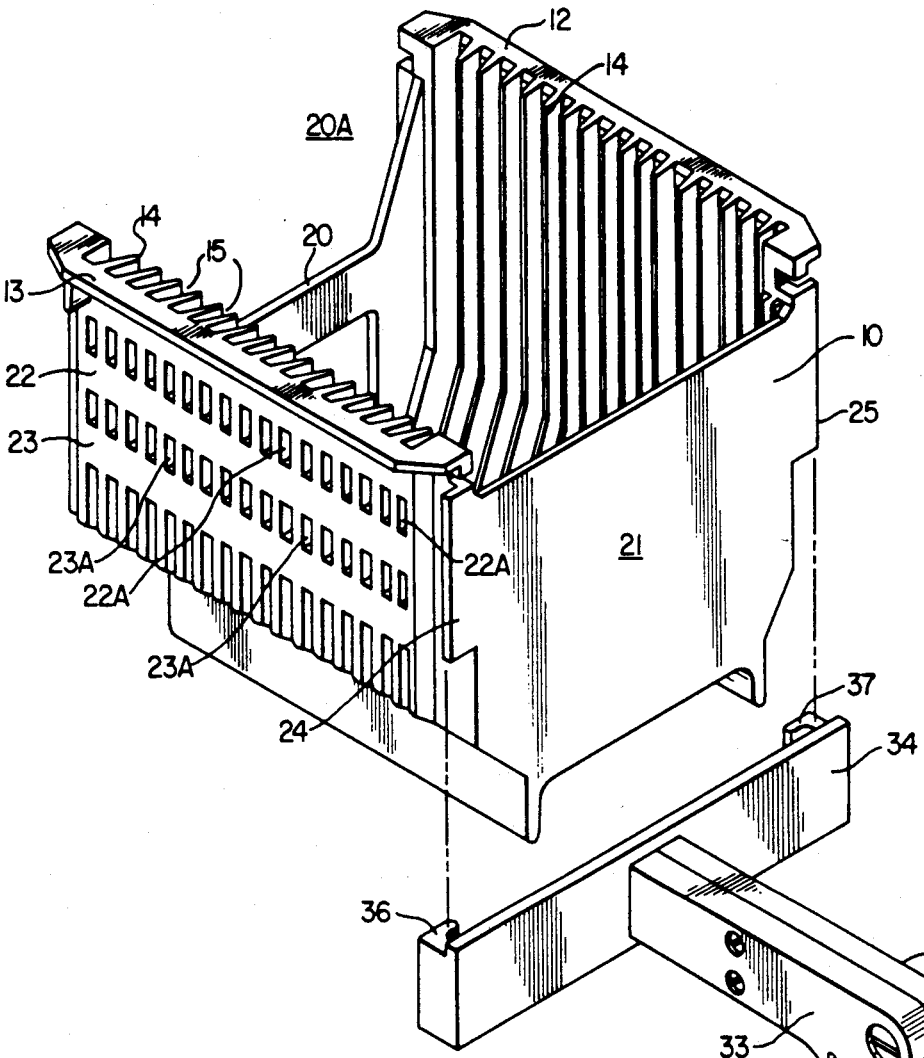
FIG. 1 is an exploded perspective view of a silicon wafer handling cassette and a removable handle assembly constructed in accordance with the principle of the present invention exploded therefrom.

Referring first to FIG. 1, there is shown a perspective view of a prior art silicon wafer handling cassette 10 for receiving a plurality of circular silicon wafers (not shown) containing semi-conductor devices thereon. The cassette 10 consists of an open framework having a pair of top rails 12 and 13 to which are affixed a plurality of vertically extending ribs 14 defining slots 15 between adjacent ribs with one wafer being received into each slot 15. Approximately twenty five slots 15 are generally contained in each cassette 10, which is usually closed at the bottom and open at the top. The cassette 10 has a horizontally extending front bar 20 transversely extending along the front edge and a vertical rear wall 21. Horizontal bars 22 and 23 are formed on each side of cassette 10 for the structural integrity thereof. To allow free circulation of vapor and/or fluid between the silicon wafers positioned within the slots 15 spaces 22A and 23A are provided between each of the ribs 14 and the bars 22 and 23. To further facilitate free circulation and appropriate treatment of the wafers in the slots 15 the front portion 20A of the cassette 10 is open. The cassette 10 may be received into an indexing mechanism of a wafer processing station with the front side facing downwardly, thereby placing the silicon wafers contained within the slots 15 in a horizontal configuration from which they may be systematically removed one at a time for processing.

Still referring to FIG. 1, a removable handle 30, constructed in accordance with the principles of the present invention, is shown exploded from an engaging grip onto the side of the cassette 10. The handle 30 consists of a downwardly extending grip portion 31 having a plurality of contoured finger portions 32 formed along the front edge 32A thereof and a transversely extending body 33. Mounted to body 33 is a transversely extending front coupling bar 34. Opposite ends of the bar 34 are formed with coupling channels 36 and 37. The channels 36 and 37 comprise a contoured shape that allows firm and secure sliding engagement with the rear flanges or rails 24 and 25 extending along the sides of the rear wall 21 of the cassette 10. The handle 30 also includes a trigger 41 for actuating the securing means of the handle with a cassette 10, as will be further explained below. The handle 30 also includes a thumb latch 42 which, upon pulling of the trigger to engage the cassette 10, moves into an upward, locked position, and upon depression of the latch 42, releases the securing means of the handle and restores the trigger to the deactuated position. As can be seen, the handle 30 may be easily removed from the cassette 10 when the securing means is in the deactuated position. This allows free movement of the handle 30 for selective engagement with and handling of other cassettes 10.

Figure 2:
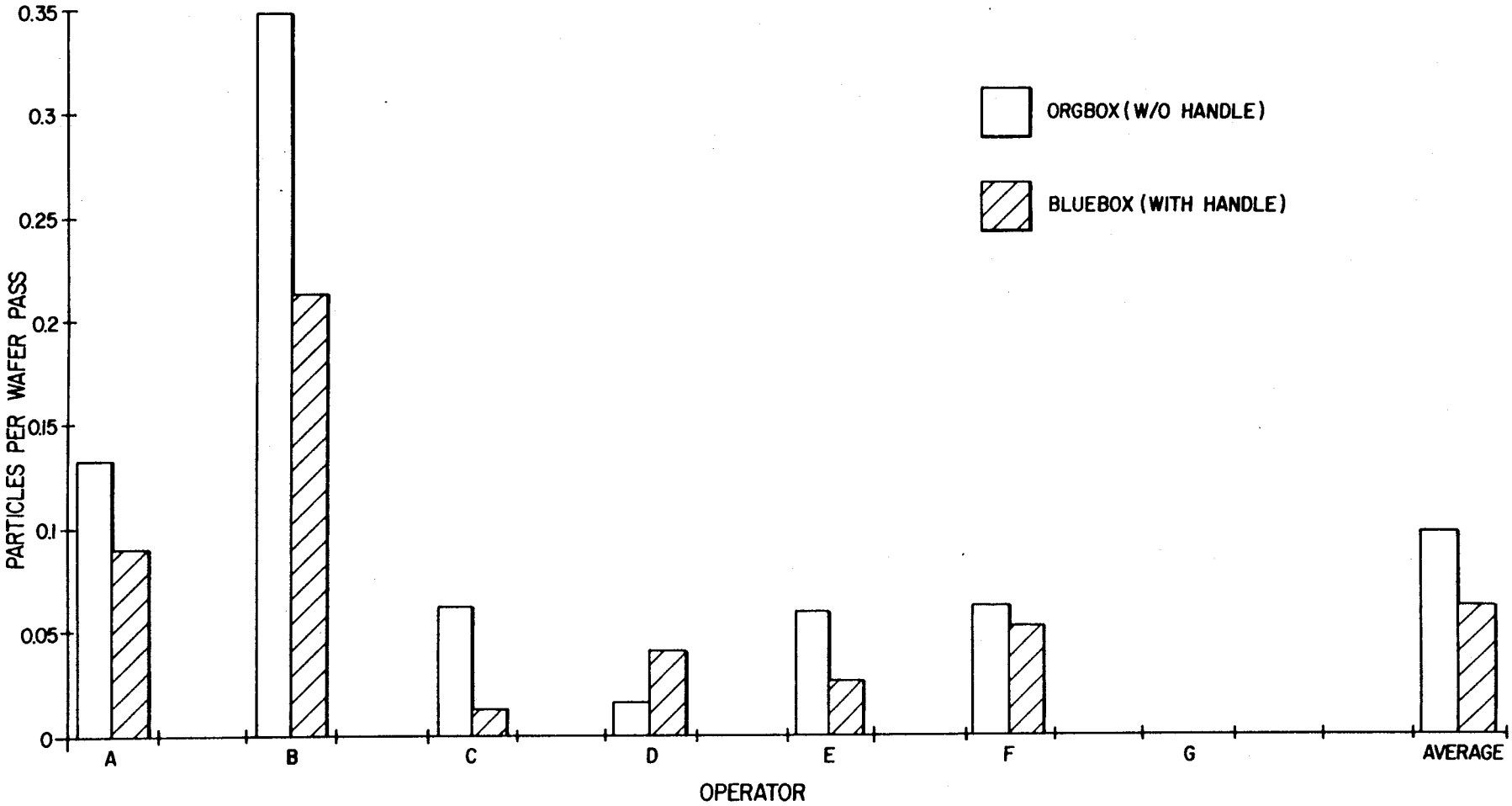
FIG. 2 is a bar graph illustrating contamination of wafers processed by different operators with and without use of the handle of the present invention.

Referring now to FIG. 2, there is shown a bar graph illustrating the relative contamination of silicon wafers as a function of the way in which operators handle the cassettes 10, wherein the wafers are stored. The left bars represent operators A-F working without a cassette handling handle, and provide a statistical representation of the number of particles of contamination per wafer pass. The right bars (cross-hatched) represent the same operators A-F with which the cassette handling handle of the present invention. These data are based upon experimental results. The graph clearly illustrates the decrease in wafer contamination by operators using the handle of the present invention. For example, operator C shows a significant decline in the number of contaminating particles per wafer pass. Similarly, operators A and B also show a decrease in their characteristic contaminant history. The chart further indicates the flexibility with which individual operators have in handling product and the resultant number of impurities that may get into the system.

The results shown in FIG. 2 also demonstrate that the operators that were given the handle 30 of the present invention achieved a higher level of purity with the handle than without the handle even though the operators were not given any particular training as to how that handle should be used. With proper instruction on how to actually use the handle, even higher yields would conceivably have been obtained by each operator. This lack of instruction probably accounts for the anomaly with operator D, who did not achieve better results with the handle.

Figure 3A:
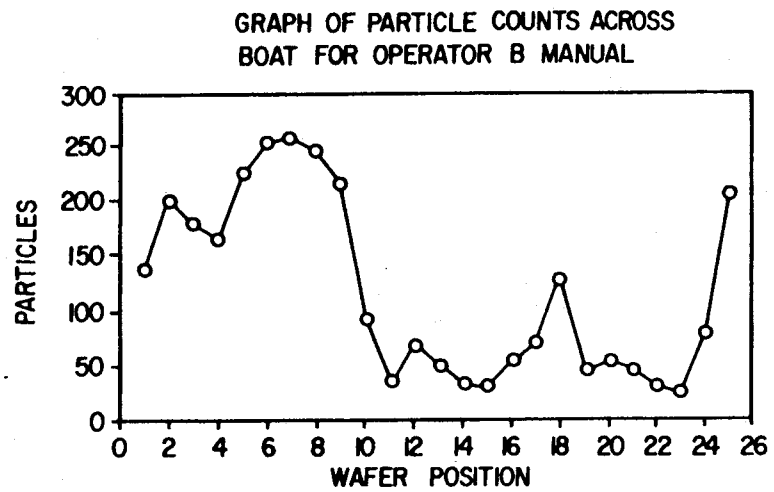
FIGS. 3A-3D are graphs of contaminant particle counts at various positions along a semi-conductor wafer processing cassette illustrating contamination as a function of the manner of handling the cassette by the operator.
Figure 3B:
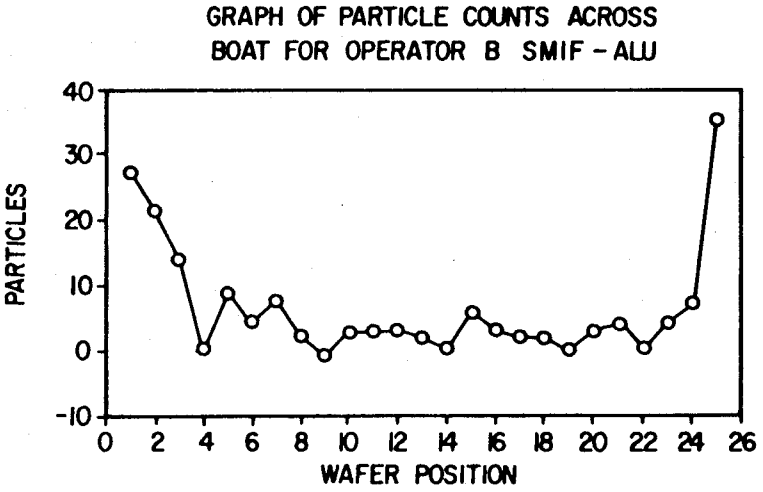
Figure 3C:
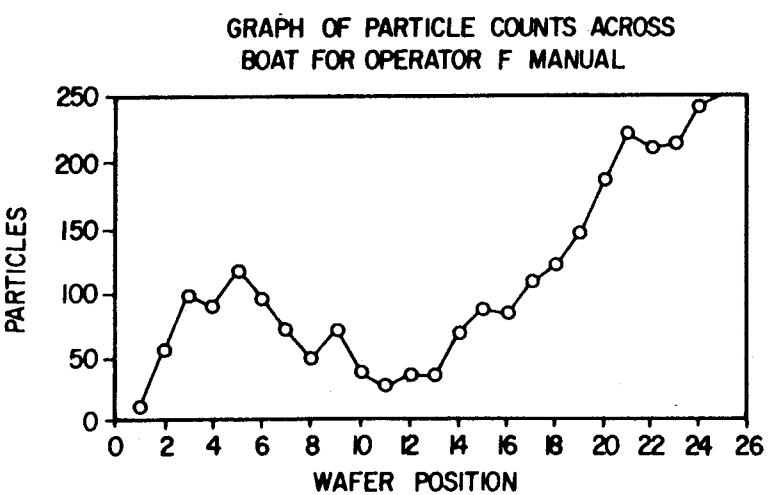
Figure 3D:
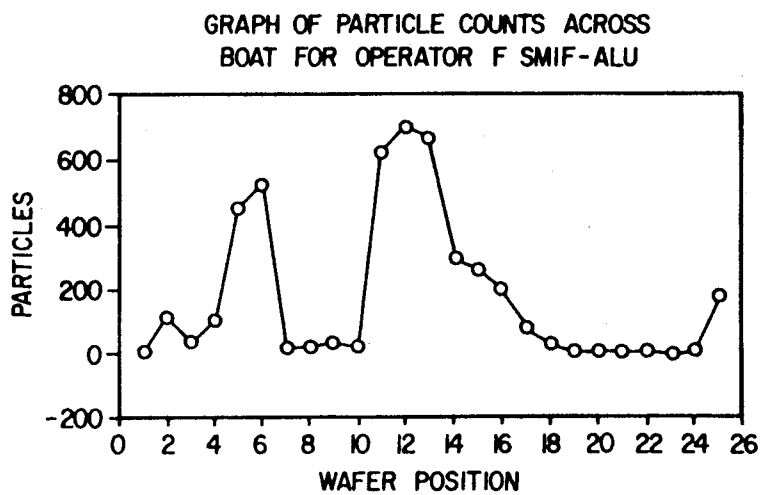

Referring now to FIGS. 3A-3D, there is shown a series of graphs representing the number of particles of impurities on particular wafers as a function of the position of the wafers within a 26 wafer cassette 10 of the type shown in FIG. 1. In FIG. 3A it is clear from the graph that the operator handling that cassette, albeit with sterile rubber gloves, gripped the cassette 10 with one hand in the region of wafer slot #6 and with the other hand in the region of wafer slot #26. This conclusion arises from the substantially higher level of impurities on the silicon wafers contained in the slots of those wafer position numbers. Similarly, the operator handling the cassette 10 illustrated in FIG. 3B shows that that operator also gripped it with one hand near the area on one end of slot #26 and the other hand near slot #1. Similarly, FIG. 3C shows a cassette 10 which has been handled with one hand in the region of slot #4 and the other hand at the far end of the cassette 10 in the vicinity of slots #20 and #26. Finally, FIG. 3D illustrates a technique of handling which included gripping the cassette in the areas of slots #4 and slots #12.

It can be seen from the graphs of FIGS. 3A-3D that there is a marked correlation between the contact points of the operator's gloved hand with the cassette 10 and the number of particles contained on the wafers contained within that particular region of the cassette. It is for this reason that the present invention proposes to include a handle 30 that allows handling of the cassette 10 without bringing the hand of the operator any closer than approximately 6 inches from the cassette 11. While a greater distance than 6 inches might also prove very helpful, the greater distance would involve a longer lever arm and remote actuation by the operator. These factors result in clumsiness in handling of the cassette 11 due to the length of the distance between the hand and the cassette itself.

Figure 4:
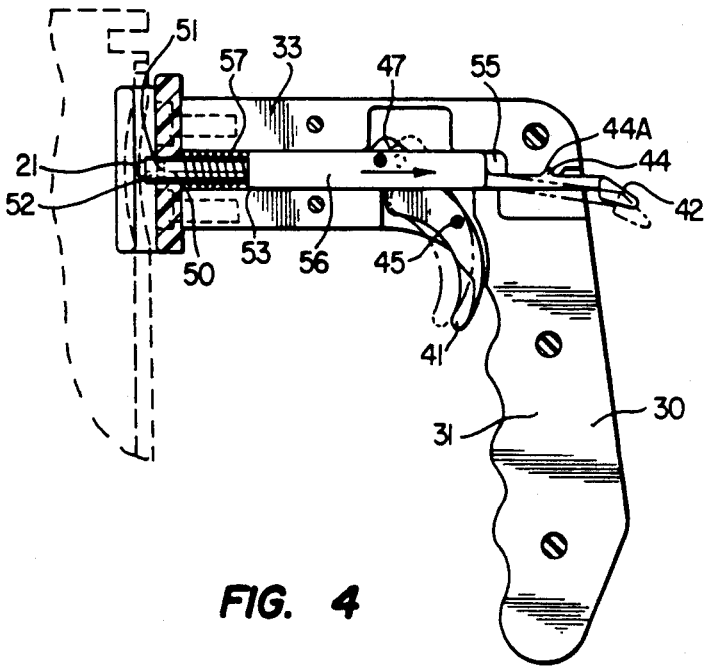
FIG. 4 is an enlarged, side elevational, cross-sectional view of the handle of FIG. 1 taken along lines 4—4 thereof.

Referring now to FIG. 4, there is shown a cross-sectional view of the handle 30 of the present invention taken along the lines 4—4 of FIG. 1 illustrating the internal workings of the system. There it is shown that the handle consists of a body 33 having a downward extending grip handle 31 and an elongate recess through the body 33 comprising a slot 55. The slot 55 has received therein an elongate rod 56. The rod 56 is constructed with latch 42 extending outwardly therefrom and flexibly formed thereon. A raised dog 44 is formed along the body of latch 42 and is adapted to be received into a recess 44A constructed in the upper portion of the handle 30 for locking the latch in the forward, or biased position. The trigger 41 is pivoted about an axis 45 to advance the rod 56 into its biased position. The upper end of the trigger 41 is attached to the rod 56 by means of a pivot 47, as described in more detail below.

Still referring to FIG. 4, the forward end of the rod 56 includes a reduced cylindrical pin 50 comprising a resilient inner rod 51 and an outer rigid covering 52 thereon. A reduced shoulder portion 53 receives a helical spring 57 around the part 52 for biasing the rod 56 in the rearward direction. Thus, it requires pressure on the trigger 41 to force the rod against the bias of the spring 57 and push the inner rod 51 into abutment with the rear wall 21 of the cassette 10 while restraining the forward edges of the cassette with the transverse coupling bar 34. In this way the resilient pin allows certain give of the material to resiliently, but firmly, grip the handle to the cassette body.

In operation, the handle 30 is slipped under the cassette 10 by running the two downwardly extending rear arms 24 and 25 of the cassette into the coupling channels 36 and 37. The handle is positioned in this interlocking configuration near the upward portion of the cassette 10 as shown in FIG. 4. Actuation of the trigger 41 then causes the rod 51 to move forward and engage the rear wall 21 of the cassette 10. The rod 51 is locked in this "outwardly biased" position through engagement of dog 44 in recess 44A. At this point, the handle 30 becomes rigidly attached to the body of the cassette itself and provides a reliable means for gripping by an operator. This secured engagement is established while the hands of the operator are at least 6 inches from the outside of the cassette 10. This distance substantially increases the yield of the semiconductor devices on the wafers within the cassette due to the reduced impurities formed on the wafers as a result of the elimination of close proximity of the human hand with the wafers.

When it is necessary to release the handle 30 from the cassette 10 in order to put the cassette 10 back into a carrying case or to use the handle on another structure, depression of the thumb latch 42 causes a release of the secured engagement. The handle 30 may then be removed from the cassette 10 by moving it downwardly and allowing the coupling channels 36 and 37 to clear the ends of the rails 24 and 25. In this way, the removable handle 30 of the present invention provides a very functional and useful device for efficiently and reliably handling wafer cassettes 10. It has been shown that use of handle 30 substantially increases the yield of the cassettes 10 by providing a number of distinct advantage over prior art handle structures.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. An operator handle for demountable securement to a cassette having at least one space adapted for receiving a silicon wafer therein, said handle comprising:

a transverse member having first and second ends;

a first end of said transverse member being constructed with a handle section for permitting an operator's grasp thereof;

means associated with said second end of said transverse member for engaging said cassette in support thereof;

means in association with said engagement means of said second end for temporarily securing said cassette to said transverse member;

said securing means comprising a coupling arm and biasing means constructed within said coupling arm for engaging said cassette and applying a securement force thereto;

said coupling arm further comprising an elongate strip orthogonally disposed across said second end of said transverse member; and said biasing means comprising a shaft reciprocally mounted within said transverse member and adapted for extending outwardly of said elongate strip into engagement with said cassette for the securement thereof.

2. The apparatus as set forth in claim 1, wherein said biasing means is actuatable from said first end of said transverse member.

3. The apparatus as set forth in claim 2, wherein said biasing means includes a trigger disposed relative to said handle section and remote from said engagement means.

4. The apparatus as set forth in claim 1, wherein said coupling arm further comprises first and second channels spaced apart one from the other and adapted for engaging oppositely disposed sections of said cassette for the support thereof.

5. The apparatus as set forth in claim 1 wherein said shaft further includes a trigger disposed adjacent said handle section for permitting actuation by an operator at a position remote from said cassette, said actuation imparting outward movement of said shaft into engagement with said cassette.

6. The apparatus as set forth in claim 5 wherein said shaft further includes locking means for temporarily securing the outward extension of said shaft and the temporary securement of said cassette to said engagement means.

7. An improved handle of the type adapted for demountably engaging a cassette, the cassette having at least one spaced adapted for receiving a silicon wafer therein, and said handle permitting the handling of said cassette by an operator, said improvement comprising:

means for temporarily securing said handle to said cassette for maintaining the secured engagement thereof:

said securing means comprising a coupling arm and biasing means constructed within said handle and said coupling arm for engaging said cassette and applying a securement force thereto;

said coupling arm comprising an elongate strip orthogonally disposed about one end of said handle; and said biasing means comprising a shaft reciprocally mounted within said transverse member and adapted for extending outwardly of said elongate strip into engagement with said cassette.

8. The apparatus as set forth in claim 7, wherein said biasing means is actuatable by an operator at a position on said handle remote from said cassette when said coupling arm is in engagement therewith.

9. The apparatus as set forth in claim 8, wherein said biasing means includes a trigger disposed upon said handle at a position remote from said cassette.

10. The apparatus as set forth in claim 7, wherein said coupling arm further comprises first and second channels spaced apart one from the other and adapted for engaging select sections of said cassette for the support thereof.

11. The apparatus as set forth in claim 7 wherein said shaft further includes a trigger disposed upon said handle at a position remote from said cassette when said coupling arm is in engagement therewith for permitting actuation of said shaft by an operator at a position remote from said cassette, said actuation imparting outward movement of said shaft into engagement with said cassette.

12. The apparatus as set forth in claim 11 wherein said shaft further includes locking means for temporarily securing the outward extension of said shaft and the temporary securement of said cassette to said coupling arm.

13. Apparatus for the secured, demountable engagement of a silicon wafer cassette for facilitating the handling thereof by an operator, said apparatus comprising:

a handle;

a transverse arm extending from said handle;

a coupling disposed on the end of said arm opposite said handle, said coupling being adapted for engaging said cassette for the support thereof;

means associated with said coupling for selectively securing said engagement with said cassette;

said securing means comprising a biasing means constructed within said coupling, said biasing means including an extendable member mounted relative to said transverse arm and adapted for extending outwardly therefrom into abutting engagement with said cassette for the securement of said cassette between said member and said coupling.

14. The apparatus as set forth in claim 13, wherein said securing means is actuatable by said operator at a position remote from said coupling.

15. The apparatus as set forth in claim 14, wherein said securing means further includes a trigger, said trigger being disposed upon said transverse arm at a position remote from said coupling.

16. A method of handling a cassette of the type adapted for housing silicon wafers during wafer manufacture and processing, said method comprising the steps of:

providing a handle assembly having means for the demountable coupling to said cassette;

providing abutment means in association with said handle assembly for abutting engagement with said cassette;

engaging said cassette with said coupling means for the support of said cassette by said handle assembly;

actuating said abutment means at a position remote from said cassette;

imparting pressure from said handle assembly against said cassette with said abutment means; and restraining said cassette against said pressure by coupling means for securing said cassette relative to said handle assembly.

* * * * *